US007566265B2

(12) United States Patent
Reeves

(10) Patent No.: US 7,566,265 B2
(45) Date of Patent: Jul. 28, 2009

(54) VENTED RIDGE SEAL ASSEMBLY

(75) Inventor: Jason Reeves, Santa Clara, CA (US)

(73) Assignee: So-Lite Corporation, San Jose, CA (US)

( * ) Notice: Subject to any disclaimer, the term of this patent is extended or adjusted under 35 U.S.C. 154(b) by 383 days.

(21) Appl. No.: 11/614,650

(22) Filed: Dec. 21, 2006

(65) Prior Publication Data

US 2007/0149110 A1 Jun. 28, 2007

Related U.S. Application Data

(60) Provisional application No. 60/753,470, filed on Dec. 22, 2005.

(51) Int. Cl.
*F24F 7/02* (2006.01)

(52) U.S. Cl. ..... 454/365

(58) Field of Classification Search ..... 454/365
See application file for complete search history.

(56) References Cited

U.S. PATENT DOCUMENTS 5,050,489 A * 9/1991 Mankowski ..... 454/365
5,112,278 A * 5/1992 Roberts ..... 454/365
5,605,018 A * 2/1997 McElderry et al. ..... 52/57
6,810,627 B2 * 11/2004 Reeves ..... 52/57
6,840,014 B2 * 1/2005 Reeves ..... 52/57
2006/0116068 A1 * 6/2006 Grossman et al. ..... 454/365
2006/0116069 A1 * 6/2006 Urbanski et al. ..... 454/365

* cited by examiner

*Primary Examiner*—Steve McAllister
*Assistant Examiner*—Helena Kosanovic
(74) *Attorney, Agent, or Firm*—Donald R. Boys; Central Coast Patent Agency, Inc.

(57) ABSTRACT

A ridge seal assembly has a first molded unit having a flat nailing portion and a portion to conform to pan and cap areas of roof tiles, the nailing portion and the cover portion are contiguous and may have openings. The nailing portion has a first straight edge away from the tile-cover portion. A second like unit has openings that do not align with the openings in the first portion. The first and second molded units are joined along the first and second straight edges of the nailing portions, and spaced apart along the opposite edges, such that in an orientation to place over roof tiles and nail to the ridge beam, the first unit is above the second unit.

6 Claims, 4 Drawing Sheets

VENTED RIDGE SEAL ASSEMBLY

CROSS-REFERENCE TO RELATED APPLICATIONS

The present application claims priority to provisional patent application No. 60/753,470, filed Dec. 22, 2005, all of which disclosure in incorporated at least by reference.

BACKGROUND OF THE INVENTION

1. Field of the Invention

The present invention is in the area of roofing products, and pertains more particularly to molded ridge seal assemblies with especially placed vent openings for use with tile roofs.

2. Discussion of the State of the Art

The state of the art is represented at least in part by U.S. Pat. No. 6,598,353 to the present inventor, showing ridge seals as known to the inventor for nailing to opposite sides of a ridge beam at a peak of a roof to be tiled, over tiles laid on flat portions of the roof meeting at the ridge beam, but under cap tiles to be placed after the seals are applied.

The seals a taught in the patent referenced just above provide very good sealing along the ridge of the tile roof, but are not optimum for allowing air to pass from outside to under the seal, and in many cases such venting is desirable.

What is clearly needed in the art is an apparatus and method for providing the excellent sealing typified by the seals taught in U.S. Pat. No. 6,598,353, while also allowing better ventilation.

SUMMARY OF THE INVENTION

In one embodiment of the invention a combination ridge seal assembly is provided, comprising a first molded unit having a flat nailing portion for nailing to a vertical side of a ridge beam, and a tile-cover portion with an undulating shape to conform to pan and cap areas of roof tiles, the nailing portion and the cover portion forming a contiguous, unbroken surface with no openings, the nailing portion having a first straight edge away from the tile-cover portion, and a second molded unit having a flat nailing portion for nailing to a vertical side of a ridge beam, and a tile-cover portion with an undulating shape to conform to pan and cap areas of roof tiles, the nailing portion and the cover portion forming a contiguous surface having a plurality of openings for ventilation, the nailing portion having a second straight edge away from the tile-cover portion. That the first and second molded units are joined along the first and second straight edges of the nailing portions, and spaced apart along the opposite edges, such that in an orientation to place over roof tiles and nail to the ridge beam, the first unit is above the second unit.

In one embodiment the straight edges are joined by one or more of plastic welding, riveting, or by being held together by a clip or an extrusion. Also in one embodiment the first and second molded units are spaced apart away from the joined edge by spacers placed between the units. The spacers may be one or more of plastic wedges, pins, or panels. Also in some embodiments the plurality of openings for ventilation through the second molded unit are arranged in a line in the direction of the ridge beam.

In an alternative embodiment there may be openings in both molded units, providing a combination ridge seal assembly comprising a first molded unit having a flat nailing portion for nailing to a vertical side of a ridge beam, and a tile-cover portion with an undulating shape to conform to pan and cap areas of roof tiles, the nailing portion and the cover portion forming a contiguous, unbroken surface having a plurality of openings for ventilation in a first geographic array, the nailing portion having a first straight edge away from the tile-cover portion, and a second molded unit having a flat nailing portion for nailing to a vertical side of a ridge beam, and a tile-cover portion with an undulating shape to conform to pan and cap areas of roof tiles, the nailing portion and the cover portion forming a contiguous surface having a plurality of openings for ventilation in a second geographic array, the nailing portion having a second straight edge away from the tile-cover portion. In this embodiment the first and second molded units are joined along the first and second straight edges of the nailing portions, and spaced apart along the opposite edges, such that in an orientation to place over roof tiles and nail to the ridge beam, the first unit is above the second unit, and the first a second geographic arrays ensure no overlap of openings from the first unit to the second unit.

BRIEF DESCRIPTION OF THE DRAWING FIGURES

FIG. 1 is a perspective view of a ridge seal known to the inventor.

FIG. 2*a* is a perspective view of first portion of a combination ridge seal according to an embodiment of the present invention.

FIG. 2*b* is a perspective view of second portion of a combination ridge seal according to an embodiment of the present invention.

DETAILED DESCRIPTION OF THE INVENTION

Figure 1:
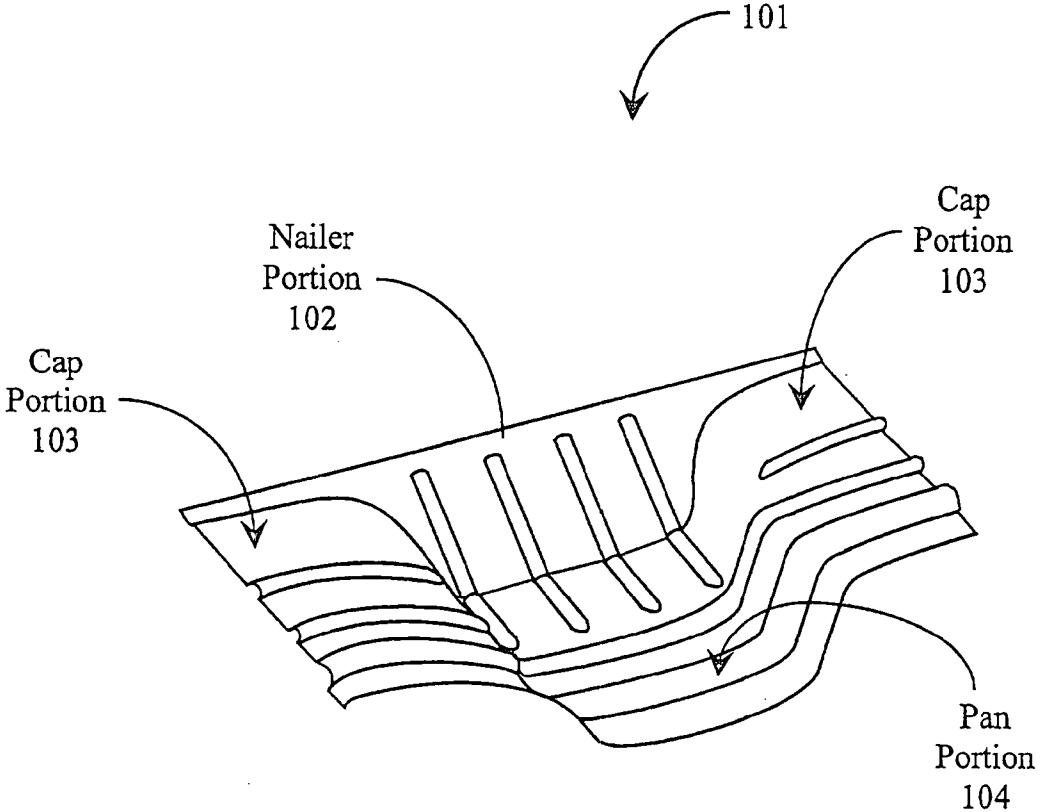
Prior Art Fig. 1

FIG. 1 is a perspective view of a portion of a ridge seal 101 known to the inventor prior to the present invention, having at least one cap portion 103, at least one pan portion 104, and a nailer portion 102. Typically a ridge seal of the sort illustrated is longer and has a plurality of cap and pan portions, but the truncated portion shown will be sufficient to describe the present invention. In use, the nailer portion of the ridge seal is nailed to a ridge beam at the peak of a roof to seal over tile and under a peak tile to be applied. No venting is provided by a seal of this sort.

Figures 2A, 2B:
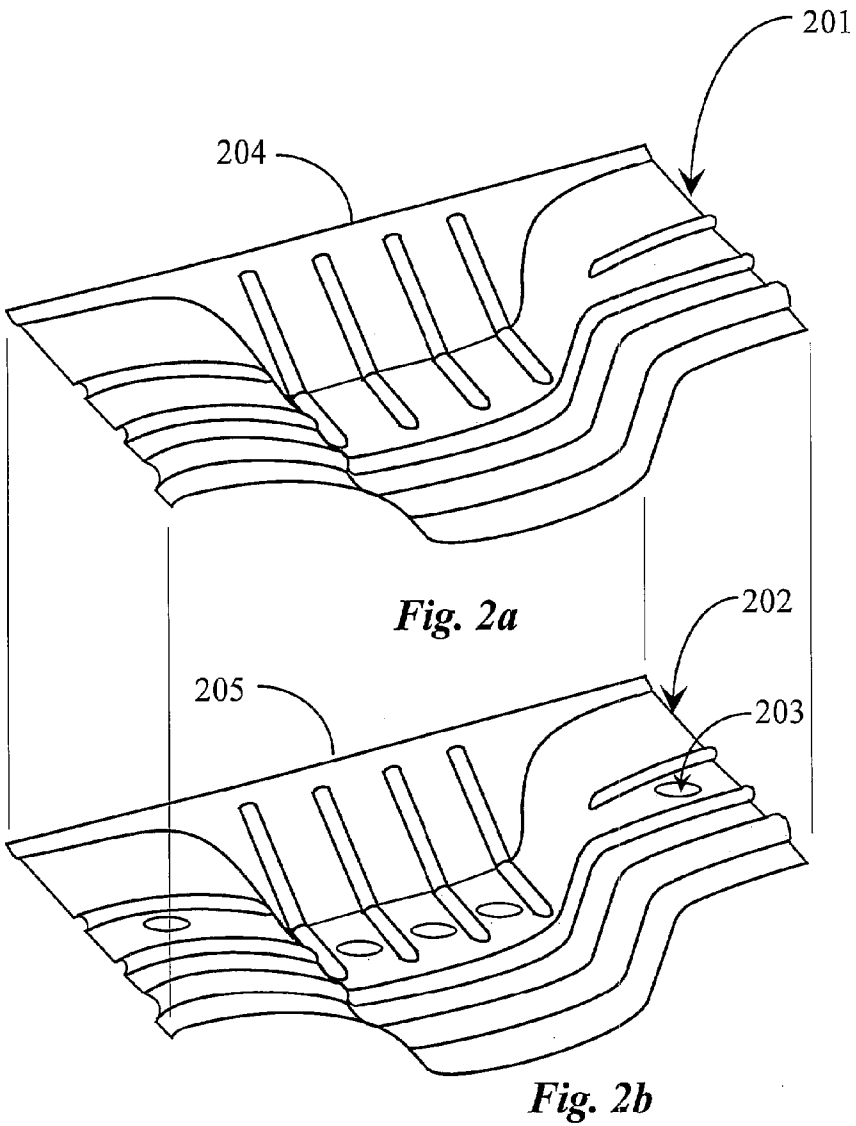

FIGS. 2*a* and 2*b* are perspective views of two portions respectively of a new ridge seal according to an embodiment of the present invention. Seal portion 201 in FIG. 2*a* is a ridge seal according to element 101 of FIG. 1. Seal portion 202 in FIG. 2*b* is the same as portion 201, except for several openings 203 through the thickness of the seal material. In this example there are five such openings 203 shown, indicating that in a longer seal there would be more openings. Each portion 201 and 202 has a back edge, 204 in portion 201, and 205 in portion 202, which is an edge at which the two portions are joined to make the assembly in an embodiment of the invention, as described further below.

Figure 3:
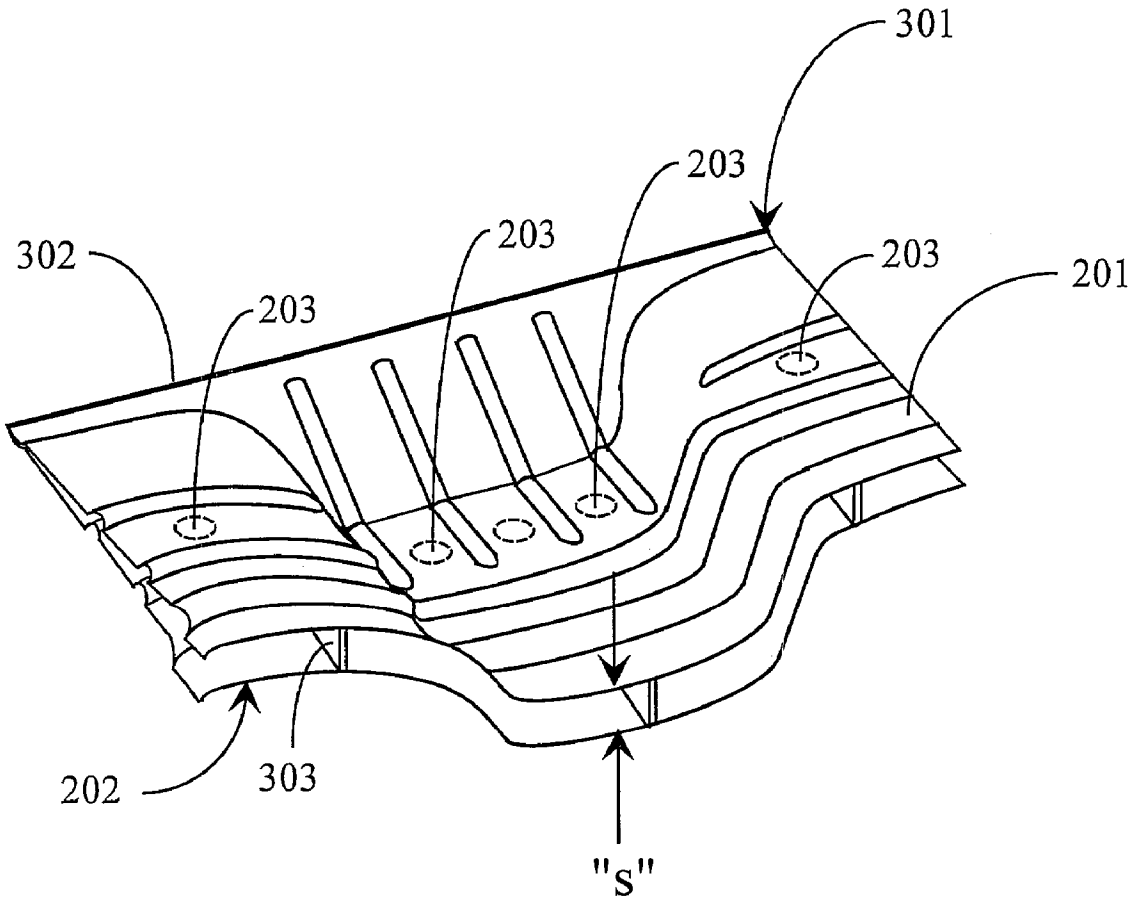
FIG. 3 is a perspective view of a combination ridge seal incorporating the parts shown in FIGS. 2*a* and 2*b*, and joined along an edge.

FIG. 3 is a perspective view of a combination ridge seal 301 incorporating the parts 201 and 202 shown in FIGS. 2*a* and 2*b*, and joined along edges 204 and 205, which in the joining becomes a single edge 302. In this view openings 203 are shown as broken-line ovals (hidden lines), because the openings are in part 202, and are not actually visible from the vantage of FIG. 3.

Edge 302 joining the two parts 201 and 202 may be joined in any one of several ways, such as heating and rolling the edge, as the parts are molded from heat deformable plastic. The edge could be joined also in a plastic welding operation, by an adhesive, by rivets, plastic spot-welded, by clips or extrusions fitted over the lined-up edges, and in several other ways. In some cases the integrity of the newly-formed edge will be sufficient to cause a separation "s", which may vary from almost no separation to as much as an inch or so in different cases. In other cases spacers may be used, such as wedge-shaped spacers 303 shown in FIG. 3. Other sorts of spacers may be suitable as well, such as simply small rods or intermittent pieces along the front edge opposite joined edge 302. There are many possibilities for shape and positioning of spacers.

Figure 4:
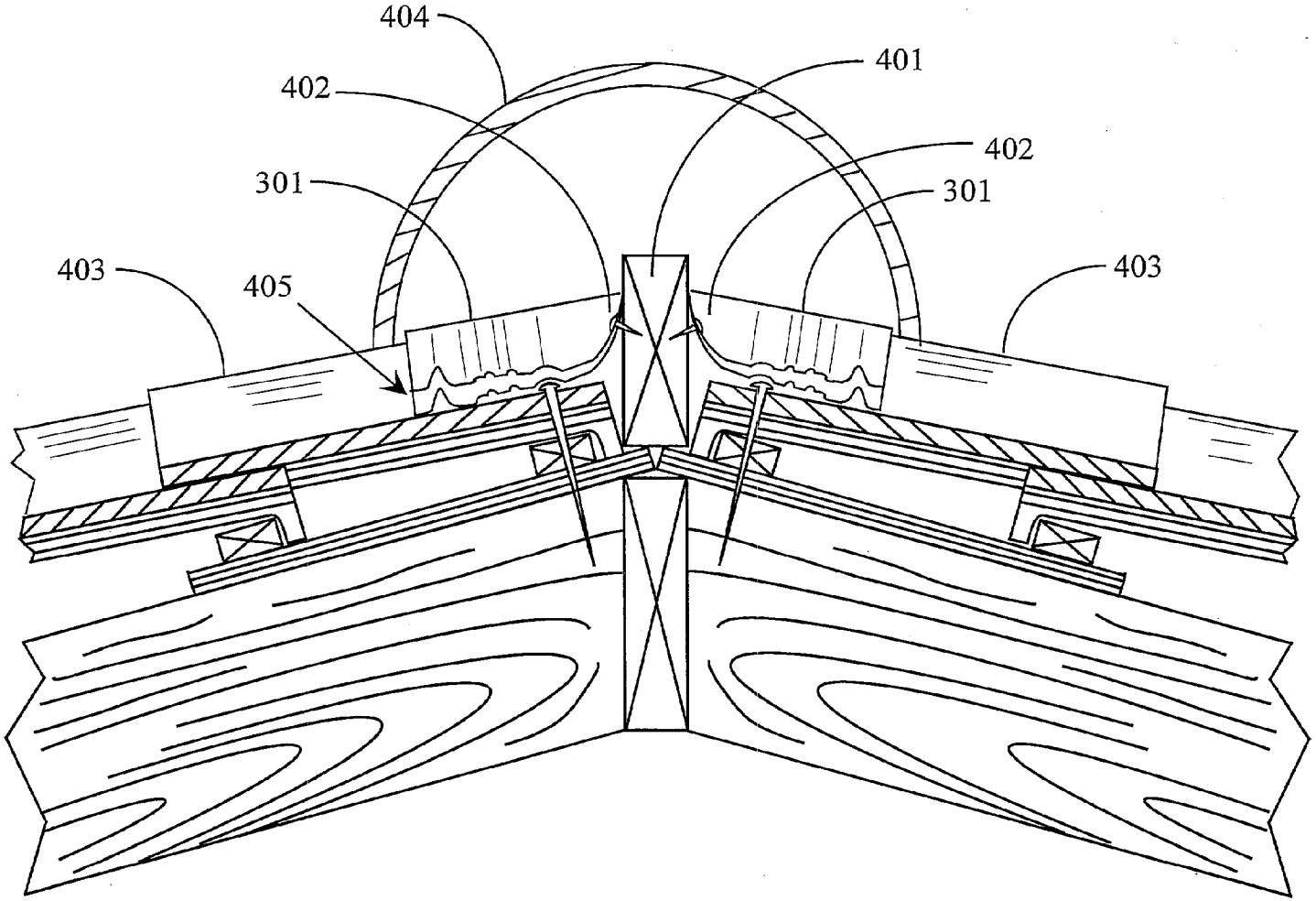
FIG. 4 is an elevation view showing the ridge seal of FIG. 3 relative to components of a tile roof and ridge beam.

FIG. 4 is an elevation view showing ridge seal assemblies 301 of FIG. 3 relative to components of a tile roof and ridge beam. FIG. 4 is a cross-section of a tiled roof taken along a line orthogonal to the direction of ridge beam 401 and through pan portions of the seal members 301 and tiles 403. Before cap tile 404 is placed, seals 301 are placed over tiles and nailed at positions 402, through the nailing portions of the seal members, to ridge beam 401. When the seals are in place cap tiles 404 are placed, and a gap 405 is left because cap tiles 404 span across the caps of the roof tiles. The double nature of the vented seal prevents moisture from seeping into the ridge area, and provides ventilation between the upper and lower portions, 201 and 202 respectively (see FIG. 3), and through the openings 203 in lower portions 202.

In an alternative embodiment of the invention both the upper and lower portions may have vent openings, but the upper openings will be placed so there is no direct alignment from the upper openings to the lower openings, which would allow condensed moisture to pass through the upper openings and then directly through the lower openings. One might have, for example holes in a line in the direction of the ridge beam in the upper portion and in the lower portion as well, but the spacing of the holes in the direction of the beam would be such that there is no overlap in that direction.

Further to the above there may be many alterations in the materials used, and in the design to produce the desired effects, and in scale. There are similarly many other alterations within the spirit and scope of the invention, so the invention is entitled to the scope of the claims that follow:

What is claimed is:

1. A combination ridge seal assembly, comprising:

a first molded unit having a flat nailing portion for nailing to a vertical side of a ridge beam, and a tile-cover portion with an undulating shape to conform to pan and cap areas of roof tiles, the nailing portion and the cover portion forming a contiguous, unbroken surface with no openings, the nailing portion having a first straight edge away from the tile-cover portion; and a second molded unit having a flat nailing portion for nailing to a vertical side of a ridge beam, and a tile-cover portion with an undulating shape to conform to pan and cap areas of roof tiles, the nailing portion and the cover portion forming a contiguous surface having a plurality of openings for ventilation, the nailing portion having a second straight edge away from the tile-cover portion;

characterized in that the first and second molded units are joined along the first and second straight edges of the nailing portions, and spaced apart along the opposite edges, such that in an orientation to place over roof tiles and nail to the ridge beam, the first unit is above the second unit.

2. The ridge seal assembly of claim 1 wherein the straight edges are joined by one or more of plastic welding, riveting, or by being held together by a clip or an extrusion.

3. The ridge seal assembly of claim 1 wherein the first and second molded units are spaced apart away from the joined edge by spacers placed between the units.

4. The ridge seal assembly of claim 3 wherein the spacers are one or more of plastic wedges, pins, or panels.

5. The ridge seal assembly of claim 1 wherein the plurality of openings for ventilation through the second molded unit are arranged in a line in the direction of the ridge beam.

6. A combination ridge seal assembly, comprising:

a first molded unit having a flat nailing portion for nailing to a vertical side of a ridge beam, and a tile-cover portion with an undulating shape to conform to pan and cap areas of roof tiles, the nailing portion and the cover portion forming a contiguous, unbroken surface having a plurality of openings for ventilation in a first geographic array, the nailing portion having a first straight edge away from the tile-cover portion; and a second molded unit having a flat nailing portion for nailing to a vertical side of a ridge beam, and a tile-cover portion with an undulating shape to conform to pan and cap areas of roof tiles, the nailing portion and the cover portion forming a contiguous surface having a plurality of openings for ventilation in a second geographic array, the nailing portion having a second straight edge away from the tile-cover portion;

characterized in that the first and second molded units are joined along the first and second straight edges of the nailing portions, and spaced apart along the opposite edges, such that in an orientation to place over roof tiles and nail to the ridge beam, the first unit is above the second unit, and the first a second geographic arrays ensure no overlap of openings from the first unit to the second unit.

* * * * *